US007357177B2

(12) United States Patent
Garwood et al.

(10) Patent No.: US 7,357,177 B2
(45) Date of Patent: Apr. 15, 2008

(54) RESTRICTION TOLERANT PACKER CUP

(75) Inventors: Michael Garwood, Yukon, OK (US); Mark Oettli, Richmond, TX (US); Frank F. Espinosa, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 299 days.

(21) Appl. No.: 11/107,116

(22) Filed: Apr. 15, 2005

(65) Prior Publication Data

US 2005/0236164 A1 Oct. 27, 2005

Related U.S. Application Data

(60) Provisional application No. 60/564,317, filed on Apr. 22, 2004.

(51) Int. Cl.
*E21B 33/12* (2006.01)

(52) U.S. Cl. ..... 166/202; 166/387

(58) Field of Classification Search ..... 166/202, 166/387

See application file for complete search history.

(56) References Cited

U.S. PATENT DOCUMENTS 1,202,319 A 10/1916 Robinson ..... 166/119
2,305,282 A * 12/1942 Taylor, Jr. et al. ..... 92/241
2,950,761 A 8/1960 Brown et al. ..... 166/119
3,012,608 A * 12/1961 McLaren, Jr. ..... 175/4.51
3,166,126 A 1/1965 Wents et al. ..... 166/120
3,703,904 A 11/1972 McClinton ..... 137/504
4,050,517 A * 9/1977 Matthews ..... 166/387
4,081,185 A 3/1978 Lane ..... 277/212
4,317,407 A 3/1982 Blackwell ..... 92/241
5,095,980 A 3/1992 Watson ..... 166/192
5,295,279 A 3/1994 Cooper ..... 15/104.061
6,481,502 B1 11/2002 Heinke et al. ..... 166/292

* cited by examiner

*Primary Examiner*—Jennifer H Gay
*Assistant Examiner*—Brad Harcourt
(74) *Attorney, Agent, or Firm*—Michael Flynn; David Cate; Robin Nava

(57) ABSTRACT

The present invention relates to a packer cup 5 having a deformable leading edge 20 which moves away from well bore or casing obstructions as the packer cup 5 is moved into a well bore. The anaxisymmetric deformable leading edge 20 can be formed by an angled leading edge 19 which presents only a portion of the leading edge 18 to a well bore obstruction and allows the edge 19 to move past the obstruction with little or no longitudinal force. Another embodiment provides an anaxisymmetric deformable leading interior edge 72 which is unduloid providing alternatively stiff and deformable sections 74, 76 of the edge 72 to move past the obstructions.

19 Claims, 3 Drawing Sheets

RESTRICTION TOLERANT PACKER CUP

CROSS-REFERENCE TO RELATED APPLICATIONS

This application claims priority from U.S. Provisional Application No. 60/564,317 filed on Apr. 22, 2004, which is incorporated by reference herein.

BACKGROUND OF THE INVENTION

1. Field of Invention

This invention relates generally to packer cups for use in a wellbore, and more specifically, to packer cups that can readily pass over obstructions or burrs on the adjacent interior surface of the well bore or casing strings.

2. Description of Related Art

Packer cups are often used to straddle a perforated zone in a wellbore and divert treating fluid into the formation behind the casing. Using packer cups is desirable since they are simple to install and do not require complex mechanisms or moving parts to position them in the wellbore. Packer cups seal the casing since they are constructed to provide a larger diameter than the casing into which they are placed to provide a slight nominal radial interference with the well bore casing. This interference, "swabbing," or "squeeze," initiates a seal to isolate the geologic zone of interest and thereby diverts the treating fluid introduced into the casing into the formation. In many operations, however, the interference or seal between the cup and the casing, or wellbore face, causes abrasive wear on the exterior lip of the cup. Packer cups can suffer damage such as cutting and gouging which occurs as a result of the cup passing through irregularities in a casing such as casing collars and perforation burrs, or by passing through a wellbore restrictions or area of damage. Many packer cup designs have been used. Known cups are generally axisymmetric, ie. having a uniform interior diameter radial distance about the longitudinal axis, and use a steel wire or steel slats to reinforce the cup. Existing cups have a leading edge that is of uniform thickness and uniform interference in the same axial plane. The reinforcing steel wire or slats prevent the rubber in the cup body from extruding when high differential pressure acts on the cup.

Packer cups were developed originally to swab wells to initiate "kick-off" (i.e. start well production). In recent years packer cups or "swab" cups have been used in fracturing or treatment operations carried out on coiled tubing or drill pipe. Such operations require higher pressures and may require multiple sets of packers or isolations across various individual zones. Thus, the demand on the sealing performance of the packer or isolation elements is high and their integrity is critical. Packer or "swab" cups that are capable of withstanding the high differential pressures encountered during fracturing or treatment operations are desired. Furthermore, a cup configuration that is capable of traversing equipment or irregularities in the borehole such as casing collars, perforation burrs, minor restrictions or well bore damage or any other type of well bore obstruction, with minimal cup damage. In known axisymmetric packer cups, the full face or leading edge of the cup encounters such well bore restrictions across its full face, requiring application of a large force to move the cup through the restriction, resulting in significant deformation and possible damage to the cup element. Subsequent to such deformation or damage, the cups may not provide the required seal. A packer or swab cup that can accommodate irregularities in casing or borehole configurations and yet withstand high differential pressures, such as those encountered during fracturing or treatment, is particularly desirable.

SUMMARY OF THE INVENTION

An embodiment of the present invention provides a packer cup for use in a casing in a well bore. In this embodiment, the packer cup comprises an elastomeric body having a first and second end, and an anaxisymmetric edge on at least one of the ends.

Another embodiment of the present invention provides a well servicing apparatus for use on a mandrel or tool in a casing in a well bore. The well servicing apparatus comprises an elastomeric body attached to the mandrel. The elastomeric body has a deformable anaxisymmetric leading edge and an outer circumferential surface that engages the interior of an adjacent surface providing a seal to prevent well fluids from flowing past such body.

In yet another embodiment of the present invention, a method is provided for straddling a perforated zone in a well bore. In this embodiment, a packer cup having an anaxisymmetric leading edge is attached to a straddling tool. The straddling tool is deployed with the packer cup attached into a well bore to a desired location. Subsequently, the fluid pressure on the packer cup is increased to isolate a geologic zone to squeeze the fluid into a well bore formation.

DETAILED DESCRIPTION OF THE INVENTION

Figure 1A:
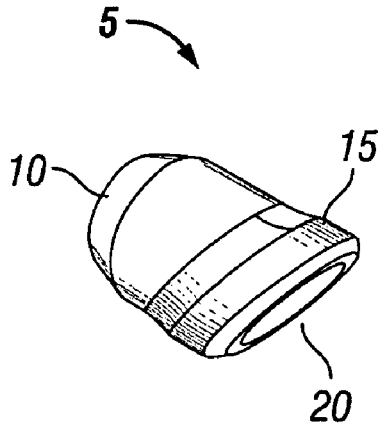
FIG. 1A is a perspective view of an anaxisymmetric packer cup of one embodiment of the present invention.
Figure 1B:
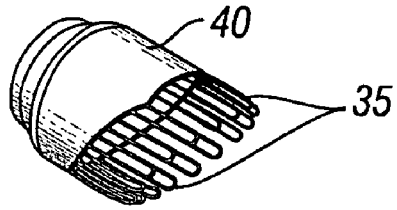
FIG. 1B is a perspective view of the wire frame which supports the elastomeric body of the packer cup of one embodiment of the present invention.
Figure 1C:
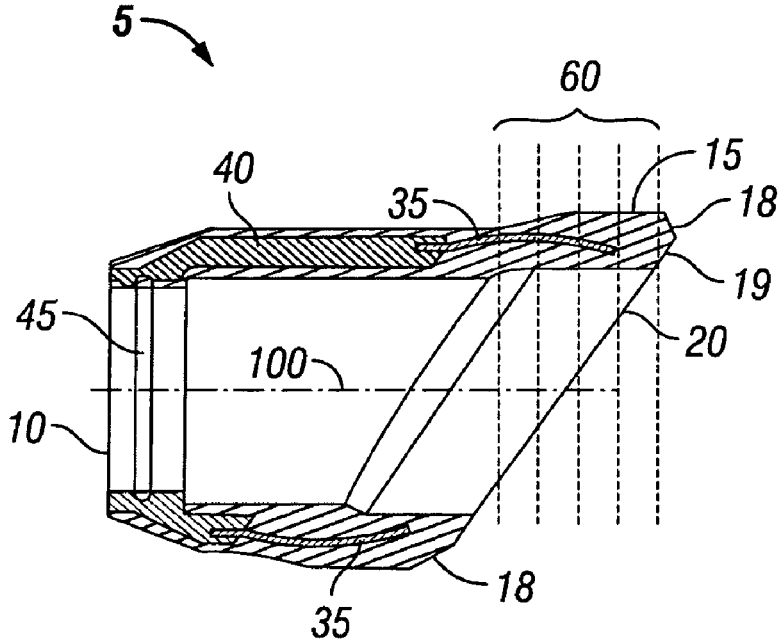
FIG. 1C is a cross-sectional view of one embodiment of the packer cup of the present invention.

FIG. 1 shows a detailed perspective drawing of a preferred embodiment of a packer cup 5 of the present invention. The cup 5 has a first end 10 and a second end 20 and is made of an elastomeric substance in a manner well known to those skilled in the industry of packer cup manufacture. As shown in FIG. 1C, cup 5 has a longitudinal axis 100. The end portion 19 of cup 5 with nominal interference into the casing bore (the outer diameter section) is slanted relative to the cup's longitudinal axis. This slant or skew ensures that only a section of the cup's outer circumferential surface 15 is squeezed in any given axial plane (noted by the dashed lines 60 in FIG. 1C). Accordingly, the leading edge 19 of the cup 5 deflects without substantial stress on the elastomeric body as the packer cup encounters a well bore obstruction.

The leading edge 19 of the packer cup 5 can also provide a portion of the leading edge 18 which is an exterior edge smaller in diameter than the diameter of the casing into which the packer is intended to be lowered, thereby allowing easier clearance for the tool as it enters the casing.

Figure 2:
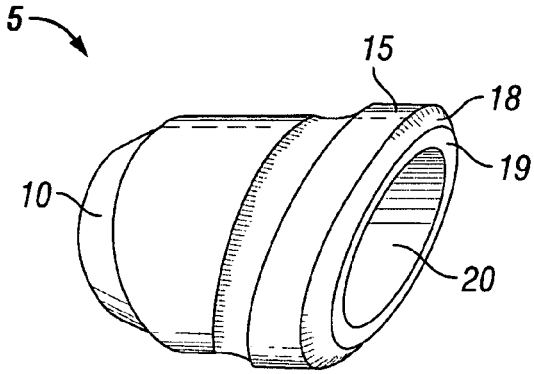
FIG. 2 is another perspective view of one embodiment of an anaxisymmetric packer cup of the present invention.
Figure 3:
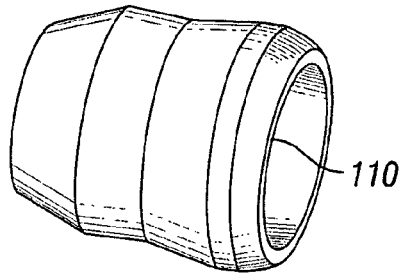
FIG. 3 (PRIOR ART)
FIG. 3 is a perspective view of a prior art packer cup.

This embodiment of the present invention, also shown in FIG. 2, has many significant advantages over a conventional axisymmetric cup such as shown in FIG. 3. For example, the frictional force to move a cup of the present invention into a casing and past any restrictions is substantially less than the frictional force required to move a conventional cup (as shown in FIG. 3) past any restriction, such as a casing collar, because the circumferential squeeze has been eliminated. In FIG. 3, the leading edge 110 encounters the collar or obstruction circumferentially and requires the entire circumference to be squeezed past the obstruction. This embodiment of the present invention, due to the anaxisymmetric shape, can bend without a complete reduction in circumference. For example if the nominal OD of an axisymmetric cup (such as FIG. 3) is 4.18" and it must travel in a 3.950" ID casing and pass a 3.850" restriction within the casing, the circumference of the cup is reduced from a length of 13.1" to a length of 12.1" while passing the restriction. However, in the present anaxisymmetric cup 5, the interfering leading edge bends with relative ease through the restriction, and the circumference of the cup 5 of the present invention remains essentially unchanged. This provides a reduction of circumferential stress that in turn reduces the internal shear stress on the rubber and greatly reduces the tendency for rubber to be pulled off any steel reinforcing wires or slats while running into a wellbore.

In some embodiments of the present invention, an anti-rotation feature may be added to the cup. If the cup is free to rotate on a mandrel or setting tool, all fixed protrusions in the wellbore may run over the same "lowest" portion of the cup thereby concentrating stress and wear damage in a particular portion of the cup, reducing its effective life. For example, if a perforation in the casing had internal upsets, the angled cup of FIG. 1, when encountering the upset, may rotate and pass the upset over the "lowest" portion 25 of the cup 5 (the portion at the bottom of FIG. 1). Therefore, by placing a pin 45 through the inner diameter of the packer of the cup 5 to be fastened to the mandrel or setting tool (not shown), rotation of the cup 5 which results from the torque exerted by the protrusions extending from perforations, upsets or obstructions in the casing bore can be avoided. Pin 45 can be fixed to the metal rib cage 40 which supports the metallic or resilient support members 35 providing extrusion support for elastomeric body of the packer cup 5.

Figure 4A:
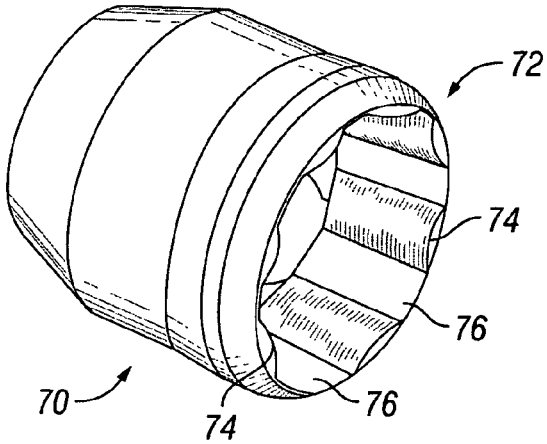
FIG. 4A is a perspective view of another embodiment of the packer cup of the present invention.
Figure 4B:
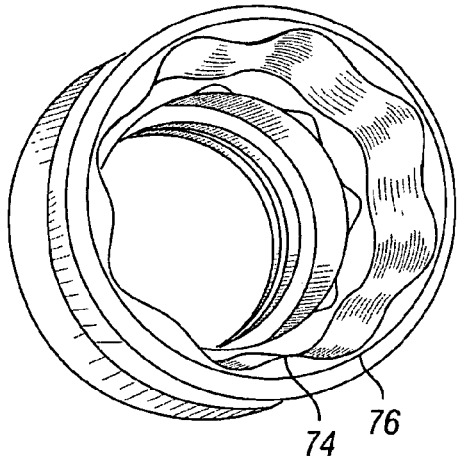
FIG. 4B is perspective end view of the embodiment shown in FIG. 4A.

FIGS. 4A and 4B illustrate an alternative embodiment of the packer cup of the present invention. In this embodiment, the packer cup 70, axisymmetric or anaxisymmetric, provides a circumferential local stiffness variation by a periodic reduction in the amount of elastomeric material which must be moved away from encountered obstructions, giving the cup the ability to collapse locally when it encounters a restriction in the adjacent surface of the casing or well bore. As shown, the interior of the leading edge 72 of the packer cup 70 is scalloped or unduloid providing alternating local areas of thick 74 and thin 76 elastomeric elements. The radial distance to the interior surfaces 74 and 76 about the central axis can vary.

Figure 5:
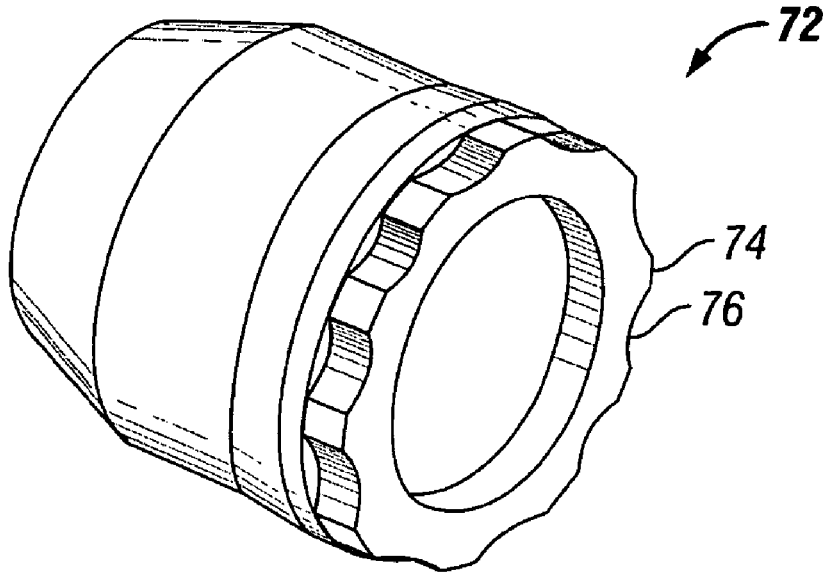
FIG. 5 is a perspective view of another embodiment of the packer cup of the present invention.

In a similar embodiment (shown in FIG. 5) the undulations 74, 76 that aid in allowing the cup 70 to move into a wellbore can be placed on the forward face of leading edge 72 instead of in the interior.

Figure 6:
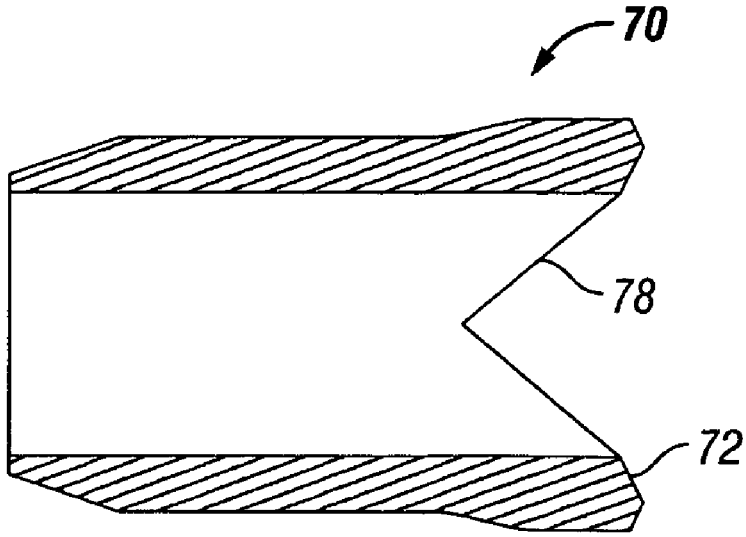
FIG. 6 is a side view of another embodiment of the packer cup of the present invention.

In an alternate embodiment, while the body of the cup 72 may be axisymmetric about a central longitudinal axis, the material properties of the cup, such as stiffness, distributed around the circumference, could be modified to give a non-axisymmetrical stiffness or flexibility to the physically-configured axisymmetric cup to further the desired result of readily moving from well bore or casing obstructions encountered when the packer cup 72 is moved into a well bore. Alternatively, as shown in FIG. 6, axisymmetric cuts 78 can be made in the leading edge 72 of the cup 70 to help guide the cup 70 through restrictions.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A packer cup for use in a casing in a well bore comprising:

an elastomeric body having first and second ends; and, an anaxisymmetric edge on at least one of said ends, wherein material properties of the cup are modified to allow for non uniform buckling through the circumference of the cup as it is passed through a restriction.

2. The packer cup of claim 1 wherein the elastomeric body has a longitudinal bore therethrough.

3. The packer cup of claim 1 wherein the elastomeric body has a plug head providing a thread connection in the longitudinal axis of the packer cup to form a plug.

4. The packer cup of claim 1 wherein the body has a variable wall thickness on at least one end permitting selective buckling of said end.

5. The packer cup of claim 1 wherein the body has a variable material composition on at least one end permitting selective buckling of said end.

6. The packer cup of claim 1 wherein a portion of a circumferential surface of said body compressively contacts an interior surface of the casing.

7. The packer cup of claim 1 wherein the anaxisymmetric edge has an exterior edge having a diameter smaller than an inner diameter of the casing.

8. A packer cup of claim 1 wherein the at least one anaxisymmetric end is angled from a perpendicular plane from the longitudinal axis.

9. A packer cup of claim 1 wherein at least one end has an unduloid interior on said end.

10. A packer cup of claim 1 further comprising a pin connected to the packer cup for attachment to a tool to minimize rotation of the cup.

11. A packer cup for use in a casing in a well bore comprising:

an elastomeric body having first and second ends;

an anaxisymmetric edge on at least one of said ends; and a pin connected through the inner diameter of the packer cup for attachment to a tool to minimize rotation of the cup.

12. A well servicing apparatus for use on a mandrel or tool in a casing in a well bore comprising:

an elastomeric body attached to said mandrel;

said elastomeric body having a deformable anaxisymmetric leading edge on at least one end thereof; and, an outer circumferential surface which engages the interior of an adjacent surface providing a seal to prevent well fluids from flowing past such body, wherein the elastomeric body has a variable material composition of the deformable leading edge permitting selective buckling of said at least one end.

13. The well servicing apparatus of claim 12 wherein the elastomeric body has a variable wall thickness of the deformable leading edge, permitting selective buckling of said at least one end.

14. The well servicing apparatus of claim 12 further comprising a pin attached to the apparatus adapted to connect to the mandrel or tool to prevent rotation of the cup as it encounters obstructions in a well bore.

15. The well servicing apparatus of claim 12 wherein the deformable anaxisymmetric edge has an exterior edge having a diameter smaller than an inner diameter of the casing.

16. The well servicing apparatus of claim 12 wherein the deformable anaxisymmetric edge is angled from a perpendicular plane from the longitudinal axis.

17. The well servicing apparatus of claim 12 wherein the anaxisymmetric edge has an unduloid interior on said at least one end.

18. A well servicing apparatus for use on a mandrel or tool in a casing in a well bore comprising:

an elastomeric body attached to said mandrel;

said elastomeric body having a deformable anaxisymmetric leading edge on at least one end thereof;

an outer circumferential surface which engages the interior of an adjacent surface providing a seal to prevent well fluids from flowing past such body; and a pin attached through the inner diameter of the apparatus adapted to connect to the mandrel or tool to prevent rotation of the cup as it encounters obstructions in a well bore.

19. A method for straddling a perforated zone in a well bore comprising:

attaching a packer cup to a straddling tool, said packer cup having an anaxisymmetric leading edge, wherein material properties of the cup are modified to allow for non uniform buckling through the circumference of the cup as it is passed through a restriction;

deploying the straddling tool with packer cup attached into a well bore to a desired location; and, increasing fluid pressure on the packer cup to isolate a geologic zone to squeeze the fluid into a well bore formation.

* * * * *